US010378542B2

(12) United States Patent
Stover

(10) Patent No.: US 10,378,542 B2
(45) **Date of Patent: *Aug. 13, 2019**

(54) COMPRESSOR WITH THERMAL PROTECTION SYSTEM

(71) Applicant: Emerson Climate Technologies, Inc., Sidney, OH (US)

(72) Inventor: Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 165 days.

This patent is subject to a terminal disclaimer.

(21) Appl. No.: 15/186,092

(22) Filed: Jun. 17, 2016

(65) Prior Publication Data

US 2017/0002817 A1 Jan. 5, 2017

Related U.S. Application Data

(60) Provisional application No. 62/187,350, filed on Jul. 1, 2015.

(51) Int. Cl.
*F04C 18/02* (2006.01)
*F04C 23/00* (2006.01)
(Continued)

(52) U.S. Cl.
CPC ..... *F04C 29/04* (2013.01); *F04C 18/0215* (2013.01); *F04C 18/0253* (2013.01); *F04C 27/005* (2013.01); *F04C 28/28* (2013.01); *F04C 29/12* (2013.01); *F04C 23/008* (2013.01); *F04C 28/265* (2013.01); *F04C 2240/30* (2013.01);
(Continued)

(58) Field of Classification Search
CPC ..... F04C 2270/195
See application file for complete search history.

(56) References Cited

U.S. PATENT DOCUMENTS 4,580,949 A 4/1986 Maruyama et al.
4,877,382 A 10/1989 Caillat et al.
(Continued)

FOREIGN PATENT DOCUMENTS

CN 1137614 A 12/1996
CN 1286358 A 3/2001
(Continued)

OTHER PUBLICATIONS

Non-Final Office Action regarding U.S. Appl. No. 15/186,151, dated May 3, 2018.
(Continued)

*Primary Examiner* — Mary Davis
(74) *Attorney, Agent, or Firm* — Harness, Dickey & Pierce, P.L.C.

(57) ABSTRACT

A compressor includes a housing, a partition, a first scroll, a second scroll, and a thermal protection system. The partition is disposed within the housing and defines a suction chamber and a discharge chamber. The partition includes a discharge passage in fluid communication with the discharge chamber. The thermal protection system includes a positioning body and a displacement member. The positioning body is coupled to the second scroll and translatably disposed within the discharge passage. The displacement member is disposed between the positioning body and the partition and configured to translate the second scroll relative to the first scroll between first and second positions.

10 Claims, 10 Drawing Sheets

(51) Int. Cl.

| | |
|---|---|
| ***F04C 27/00*** | (2006.01) |
| ***F04C 28/26*** | (2006.01) |
| ***F04C 28/28*** | (2006.01) |
| ***F04C 29/04*** | (2006.01) |
| ***F04C 29/12*** | (2006.01) |

(52) U.S. Cl.
CPC .... *F04C 2270/195* (2013.01); *F04C 2270/58* (2013.01); *F05C 2251/08* (2013.01)

(56) References Cited

U.S. PATENT DOCUMENTS

| | | | |
|---|---|---|---|
| 5,040,952 | A | 8/1991 | Inoue et al. |
| 5,607,288 | A | 3/1997 | Wallis et al. |
| 5,613,841 | A | 3/1997 | Bass et al. |
| 5,707,210 | A | 1/1998 | Ramsey et al. |
| 5,741,120 | A | 4/1998 | Bass et al. |
| 5,855,475 | A | 1/1999 | Fujio et al. |
| 6,047,557 | A | 4/2000 | Pham et al. |
| 6,210,120 | B1 | 4/2001 | Hugenroth et al. |
| 6,213,731 | B1 | 4/2001 | Doepker et al. |
| 6,267,565 | B1 | 7/2001 | Seibel et al. |
| 6,412,293 | B1 | 7/2002 | Pham et al. |
| 6,419,457 | B1 | 7/2002 | Seibel et al. |
| 6,457,948 | B1 | 10/2002 | Pham |
| 6,478,550 | B2 | 11/2002 | Matsuba et al. |
| 6,679,683 | B2 | 1/2004 | Seibel et al. |
| 6,821,092 | B1 | 11/2004 | Gehret et al. |
| 6,896,498 | B1 | 5/2005 | Patel |
| 7,510,382 | B2 | 3/2009 | Jeong |
| 7,547,202 | B2 | 6/2009 | Knapke |
| 7,771,178 | B2 | 8/2010 | Perevozchikov et al. |
| 7,972,125 | B2 | 7/2011 | Stover et al. |
| 8,517,703 | B2 | 8/2013 | Doepker |
| 8,790,098 | B2 | 7/2014 | Stover et al. |
| 8,932,036 | B2 | 1/2015 | Monnier et al. |
| 2004/0136854 | A1 | 7/2004 | Kimura et al. |
| 2006/0198748 | A1 | 9/2006 | Grassbaugh et al. |
| 2008/0159893 | A1 | 7/2008 | Caillat |
| 2013/0089448 | A1 | 4/2013 | Ginies et al. |
| 2015/0354719 | A1 | 12/2015 | van Beek et al. |
| 2016/0201673 | A1 | 7/2016 | Perevozchikov et al. |
| 2017/0002818 | A1 | 1/2017 | Stover |
| 2017/0030354 | A1 | 2/2017 | Stover |
| 2017/0306960 | A1 | 10/2017 | Pax et al. |
| 2018/0149155 | A1 | 5/2018 | Akei et al. |

FOREIGN PATENT DOCUMENTS

| | | | |
|---|---|---|---|
| CN | 1289011 | A | 3/2001 |
| CN | 1828022 | A | 9/2006 |
| CN | 102089525 | A | 6/2011 |
| CN | 205876712 | U | 1/2017 |
| CN | 205895597 | U | 1/2017 |
| GB | 2107829 | A | 5/1983 |
| JP | S6385277 | A | 4/1988 |
| JP | H0281982 | A | 3/1990 |
| JP | H04272490 | A | 9/1992 |
| JP | 2003074482 | A | 3/2003 |
| WO | WO-2009/017741 | A1 | 2/2009 |
| WO | WO-2009155099 | A2 | 12/2009 |

OTHER PUBLICATIONS

Office Action regarding Chinese Patent Application No. 201610158216.X, dated Jun. 13, 2018. Translation provided by Unitalen Attorneys at Law.

Office Action regarding Chinese Patent Application No. 201610499158.7, dated Aug. 1, 2018. Translation provided by Unitalen Attorneys at Law.

Office Action regarding Chinese Patent Application No. 201610499158.7, dated Jan. 9, 2018. Translation provided by Unitalen Attorneys at Law.

Office Action regarding Chinese Patent Application No. 201610499158.7, dated Feb. 1, 2019. Translation provided by Unitalen Attorneys at Law.

COMPRESSOR WITH THERMAL PROTECTION SYSTEM

CROSS-REFERENCE TO RELATED APPLICATIONS

This application claims the benefit of U.S. Provisional Application No. 62/187,350, filed on Jul. 1, 2015. The entire disclosure of the above application is incorporated herein by reference.

FIELD

The present disclosure relates to a compressor, and more specifically to a compressor having a thermal protection system with a thermally-responsive material.

BACKGROUND

This section provides background information related to the present disclosure and is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

According to one aspect, the present disclosure provides a compressor. The compressor may include a housing, a partition, a first scroll, a second scroll, and a thermal protection system. The partition may be disposed within the housing and define a suction chamber and a discharge chamber. The partition may include a discharge passage in fluid communication with the discharge chamber. The first scroll may be supported within the housing and include a first endplate having a first spiral wrap. The second scroll may be supported within the housing and include a second endplate having a first side and a second side opposite the first side. The first side may have a second spiral wrap meshingly engaged with the first spiral wrap to form a series of compression pockets. The thermal protection system may include a positioning body and a displacement member. The positioning body may be coupled to the second scroll and translatable relative to the discharge passage. The displacement member may be disposed between the positioning body and the partition and configured to translate the second scroll relative to the first scroll between first and second positions in response to a change in an operating temperature of the compressor.

In some configurations, the displacement member includes a shape memory material.

In some configurations, the shape memory material includes at least one of a bi-metal and tri-metal shape memory alloy.

In some configurations, the displacement member is configured to translate the second scroll in response to a change in temperature of the displacement member.

In some configurations, the second side of the second scroll includes a first recess in fluid communication with at least one of the series of compression pockets, and a second recess surrounding the first recess. The compressor may further include a seal assembly translatably disposed within the second recess and sealingly engaged with the partition. The seal assembly is displaceable between first and second positions within the second recess.

In some configurations, the positioning body includes a hub and a radially extending flange, and the displacement member engages the flange and the partition.

In some configurations, the displacement member surrounds the hub.

In some configurations, the thermal protection system further includes a control module operable to change a state of the displacement member in response to the operating temperature of the compressor.

In some configurations, the compressor includes a temperature sensor that senses the operating temperature of the compressor.

In some configurations, the temperature sensor is disposed within at least one of the discharge chamber and the suction chamber.

In some configurations, the control module is configured to selectively provide an electronic current to the displacement member to change the state of the displacement member.

According to another aspect, the present disclosure provides a compressor. The compressor may include a housing, a partition, a first scroll, a second scroll, a seal assembly, and a thermal protection system. The partition may be disposed within the housing and define a suction chamber and a discharge chamber. The partition may include a discharge passage in fluid communication with the discharge chamber. The first scroll may be supported within the housing and include a first endplate having a first spiral wrap extending therefrom. The second scroll may be supported within the housing and include a second endplate having a first side and a second side opposite the first side. The first side may include a second spiral wrap meshingly engaged with the first spiral wrap to form a series of compression pockets. The second side may include a first recess and a second recess surrounding the first recess. The first recess may be in fluid communication with at least one of the series of compression pockets. The seal assembly may be translatably disposed within the second recess between a first position and a second position. The thermal protection system may include a valve assembly having a valve housing, a valve body, and a first biasing member. The first biasing member may be configured to displace the valve body from a closed position to an open position relative to the valve housing. The valve body may inhibit fluid communication between the suction chamber and the second recess when in the closed position. The valve body may allow fluid communication between the suction chamber and the second recess when in the open position. The valve body may be displaceable between the closed and open positions in response to a change in temperature of the first biasing member.

In some configurations, the first biasing member includes a shape memory material.

In some configurations, the shape memory material includes at least one of a bi-metal and tri-metal shape memory alloy.

In some configurations, the seal assembly prevents fluid communication between the first recess and the suction chamber when the valve body is in the closed position.

In some configurations, the seal assembly allows fluid communication between the first recess and the suction chamber when the valve body is in the open position.

In some configurations, the second endplate includes a passage in fluid communication with the second recess and the suction chamber. The valve assembly may be disposed within the passage.

In some configurations, the seal assembly includes a passage in fluid communication with the second recess and the suction chamber. The valve assembly may be disposed within the passage.

In some configurations, the valve assembly includes a second biasing member configured to bias the valve body from the open position to the closed position relative to the valve housing.

According to another aspect, the present disclosure provides a compressor. The compressor may include a housing, a first scroll, a second scroll, and a thermal protection system. The housing may include a suction chamber and a discharge chamber. The first scroll may be supported within the housing and may include a first endplate having a first spiral wrap. The second scroll may be supported within the housing and may include a second endplate having a second spiral wrap meshingly engaged with the first spiral wrap to form a series of compression pockets. The second endplate may define a passage in fluid communication with the discharge chamber and the suction chamber. The thermal protection system may include a valve assembly having a valve housing, a valve body, and a first biasing member configured to displace the valve body from a first position to a second position relative to the valve housing. The valve body may prevent fluid communication between the suction chamber and the discharge chamber through the passage when the valve body is in the first position. The valve body may allow fluid communication between the suction chamber and the discharge chamber through the passage when the valve body is in the second position. The valve body may be displaceable between the first and second positions in response to a change in temperature of the first biasing member.

In some configurations, the valve assembly may include a second biasing member configured to bias the valve body from the second position to the first position relative to the valve housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 8:
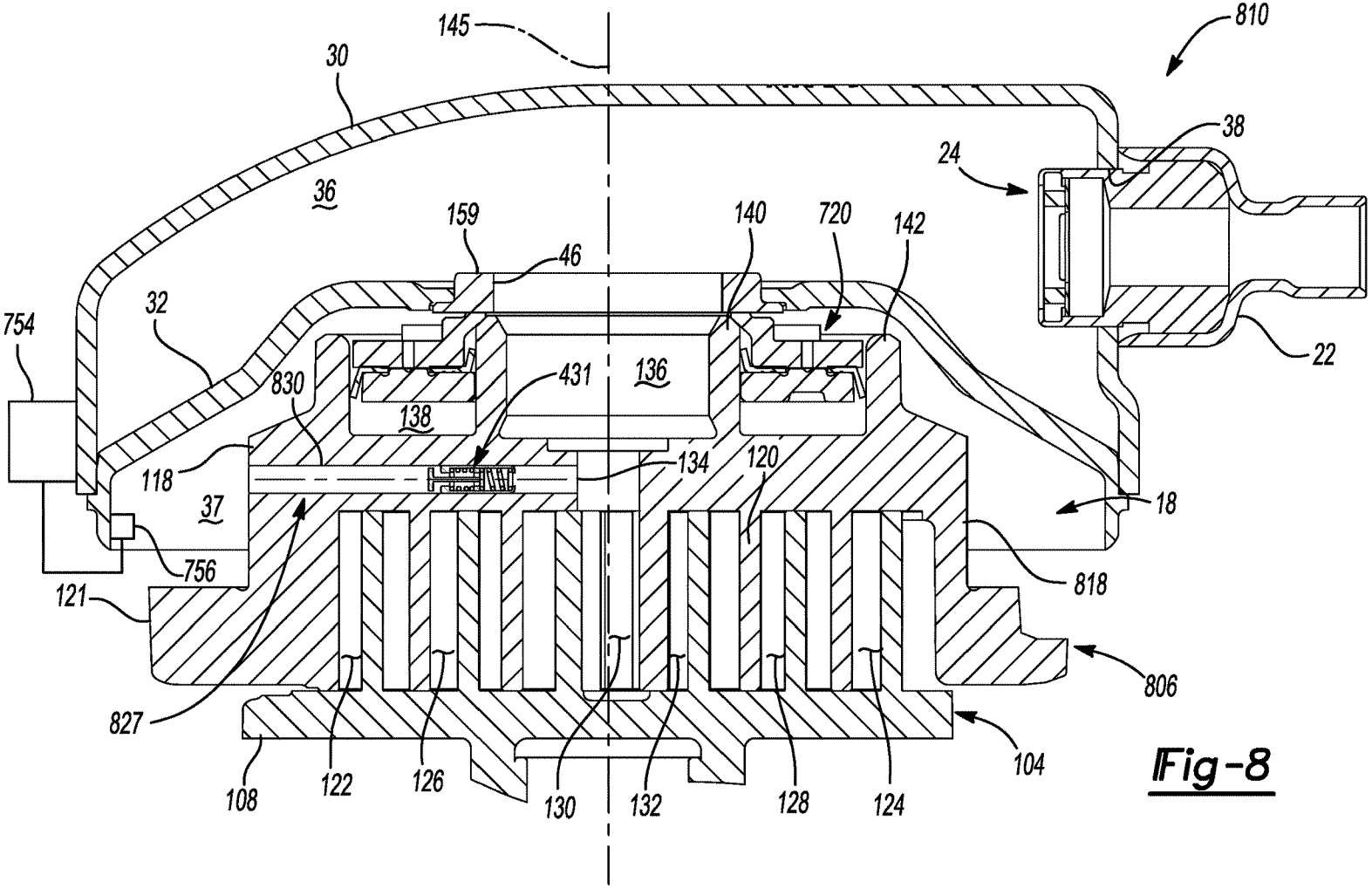
Figure 9:
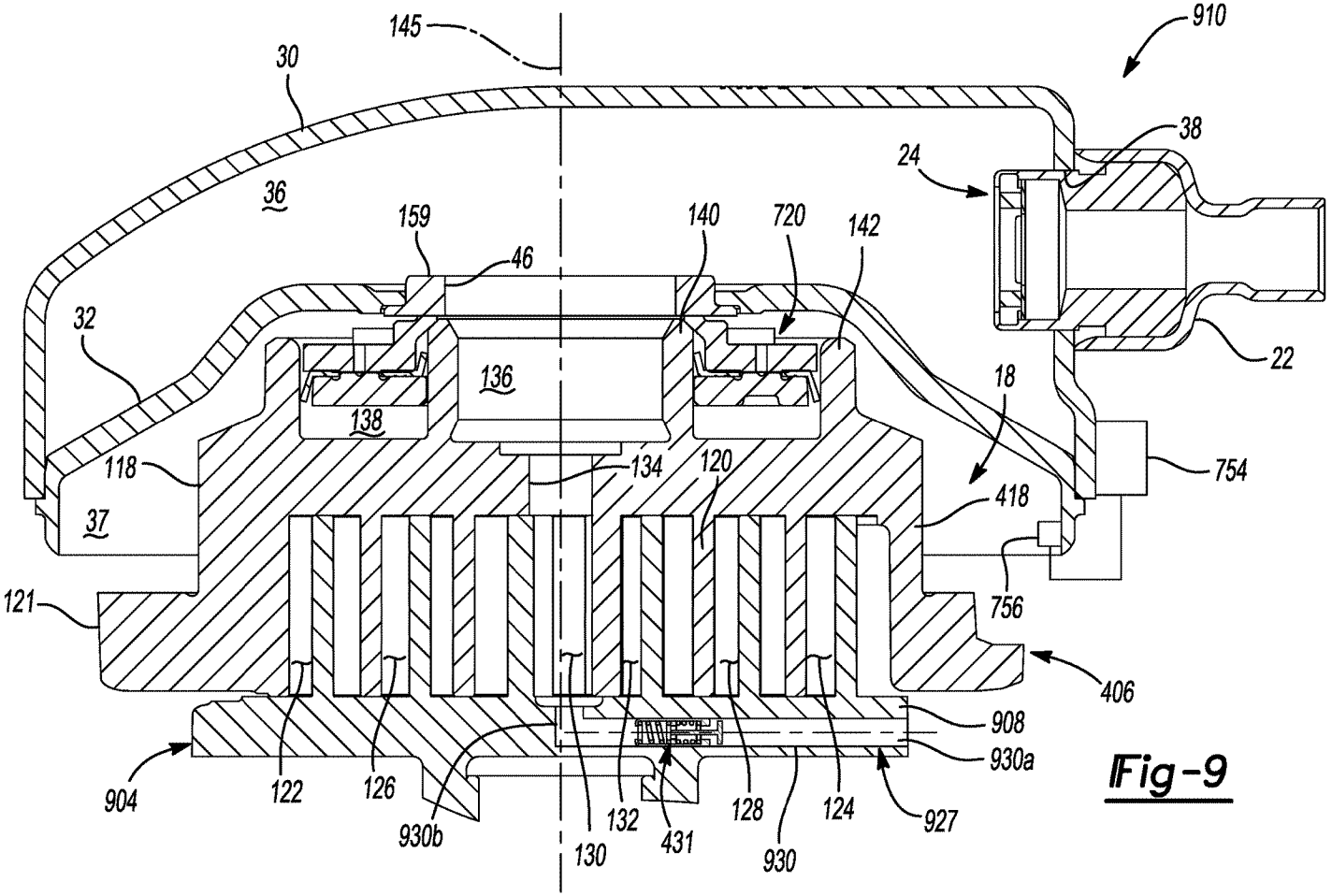

FIG. 8 is a partial cross-sectional view of a compressor incorporating another thermal protection system constructed in accordance with the principles of the present disclosure, the thermal protection system shown in an activated position causing the compressor to shut down; and FIG. 9 is a partial cross-sectional view of a compressor incorporating another thermal protection system constructed in accordance with the principles of the present disclosure, the thermal protection system shown in an activated position causing the compressor to shut down.

Corresponding reference numerals indicate corresponding parts throughout the several views of the drawings.

DETAILED DESCRIPTION

The following description is merely exemplary in nature and is not intended to limit the present disclosure, application or uses. It should be understood that throughout the drawings, corresponding reference numerals indicate like or corresponding parts and features.

The present teachings are suitable for incorporation in many types of different scroll and rotary compressors, including hermetic machines, open drive machines and non-hermetic machines. For exemplary purposes, a compressor 10 is shown as a hermetic scroll refrigerant-compressor of the low side type, i.e., where the motor and compressor are cooled by suction gas in the hermetic shell, as illustrated in the vertical section shown in FIG. 1.

Figure 1:
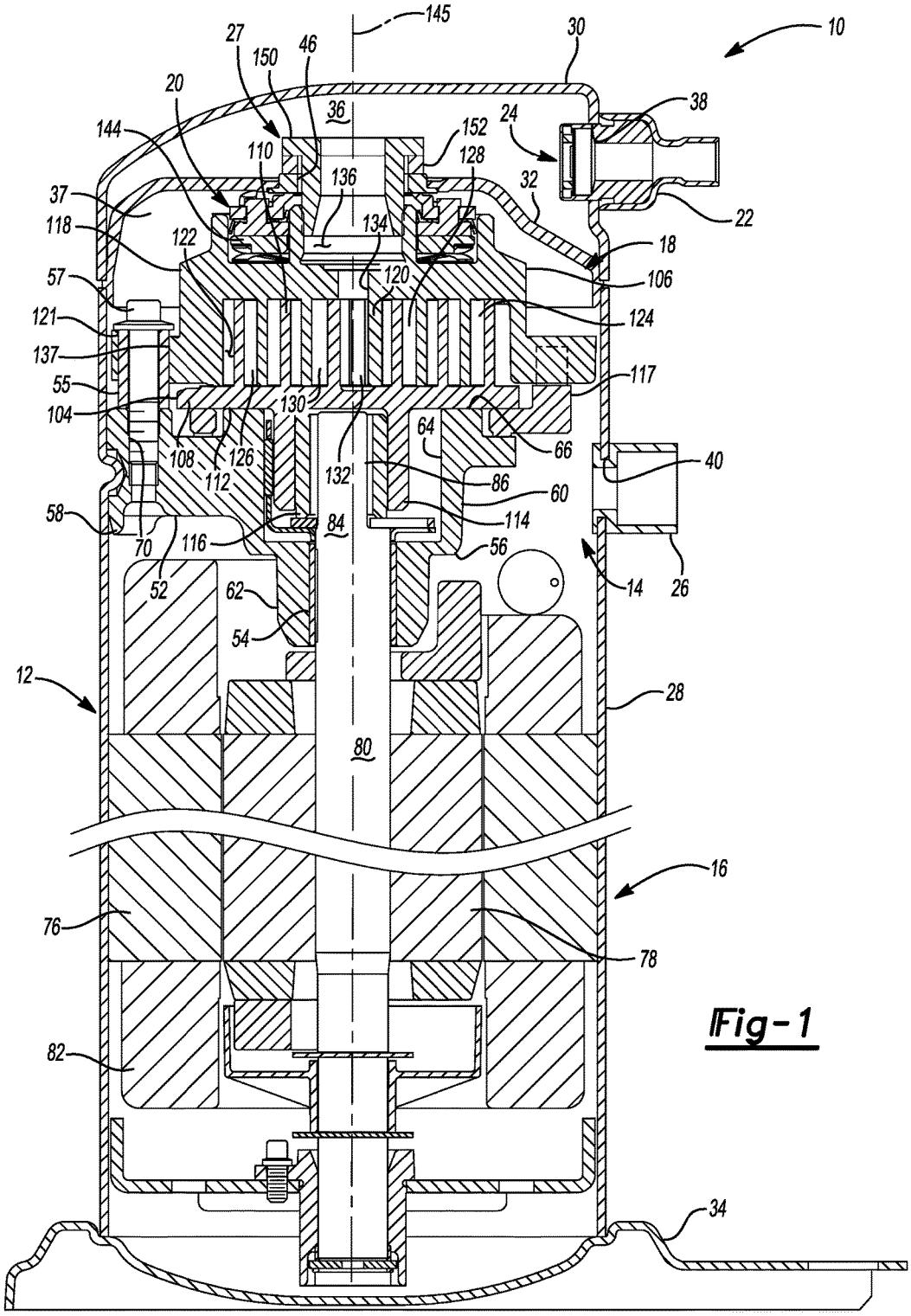
FIG. 1 is a cross-sectional view of a compressor incorporating a thermal protection system constructed in accordance with the principles of the present disclosure.

With initial reference to FIG. 1, the compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a thermal protection system 27. The shell assembly 12 may house the main bearing housing assembly 14, the motor assembly 16, and the compression mechanism 18.

The shell assembly 12 may generally form a compressor housing and may include a cylindrical shell 28, an end cap 30 at the upper end thereof, a transversely extending partition 32, and a base 34 at a lower end thereof. The end cap 30 and the partition 32 may generally define a discharge chamber 36, while the cylindrical shell 28, the partition 32, and the base 34 may generally define a suction chamber 37. The discharge chamber 36 may generally form a discharge muffler for the compressor 10. The refrigerant discharge fitting 22 may be attached to the shell assembly 12 at the opening 38 in the end cap 30. The discharge valve assembly 24 may be located within the discharge fitting 22 and may generally prevent a reverse flow condition. The suction gas inlet fitting 26 may be attached to the shell assembly 12 at the opening 40, such that the suction gas inlet fitting 26 is in fluid communication with the suction chamber 37. The partition 32 may include a discharge passage 46 therethrough that provides communication between the compression mechanism 18 and the discharge chamber 36.

The main bearing housing assembly 14 may be affixed to the shell 28 at a plurality of points in any desirable manner, such as staking. The main bearing housing assembly 14 may include a main bearing housing 52, a first bearing 54 disposed therein, bushings 55, and fasteners 57. The main bearing housing 52 may include a central body portion 56 having a series of arms 58 that extend radially outwardly therefrom. The central body portion 56 may include first and second portions 60 and 62 having an opening 64 extending therethrough. The second portion 62 may house the first bearing 54 therein. The first portion 60 may define an annular flat thrust bearing surface 66 on an axial end surface thereof. The arm 58 may include apertures 70 extending therethrough that receive the fasteners 57.

The motor assembly 16 may generally include a motor stator 76, a rotor 78, and a drive shaft 80. Windings 82 may pass through the motor stator 76. The motor stator 76 may be press-fit into the shell 28. The drive shaft 80 may be rotatably driven by the rotor 78. The rotor 78 may be press-fit on the drive shaft 80. The drive shaft 80 may include an eccentric crank pin 84 having a flat 86 thereon.

The compression mechanism 18 may generally include an orbiting scroll 104 and a non-orbiting scroll 106. The orbiting scroll 104 may include an endplate 108 having a spiral vane or wrap 110 on the upper surface thereof and an annular flat thrust surface 112 on the lower surface. The thrust surface 112 may interface with the annular flat thrust bearing surface 66 on the main bearing housing 52. A cylindrical hub 114 may project downwardly from the thrust surface 112 and may have a drive bushing 116 rotatably disposed therein. The drive bushing 116 may include an inner bore in which the crank pin 84 is drivingly disposed. The crank pin flat 86 may drivingly engage a flat surface in a portion of the inner bore of the drive bushing 116 to provide a radially compliant driving arrangement. An Oldham coupling 117 may be engaged with the orbiting and non-orbiting scrolls 104, 106 to prevent relative rotation therebetween.

The non-orbiting scroll 106 may include an endplate 118 having a spiral wrap 120 on a lower surface thereof and a series of radially outwardly extending flanged portions 121. The spiral wrap 120 may form a meshing engagement with the wrap 110 of the orbiting scroll 104, thereby creating compression pockets, including an inlet pocket 122, intermediate pockets 124, 126, 128, 130, and an outlet pocket 132. The non-orbiting scroll 106 may be axially displaceable relative to the main bearing housing assembly 14, the shell assembly 12, and the orbiting scroll 104. The non-orbiting scroll 106 may include a discharge passage 134 in communication with the outlet pocket 132 and an upwardly open recess 136. The upwardly open recess 136 may be in fluid communication with the discharge chamber 36 via the discharge passage 46 in the partition 32.

The flanged portions 121 may include openings 137 therethrough. Each opening 137 may receive a bushing 55 therein. The respective bushings 55 may receive fasteners 57. The fasteners 57 may be engaged with the main bearing housing 52 and the bushings 55 may generally form a guide for axial displacement of the non-orbiting scroll 106. The fasteners 57 may additionally prevent rotation of the non-orbiting scroll 106 relative to the main bearing housing assembly 14. The non-orbiting scroll 106 may include an annular recess 138 in the upper surface thereof defined by parallel and coaxial inner and outer sidewalls 140, 142.

The seal assembly 20 may include a floating seal 144 located within the annular recess 138. The seal assembly 20 may be axially displaceable relative to the shell assembly 12 and/or the non-orbiting scroll 106 to provide for axial displacement (i.e., displacement parallel to an axis of rotation 145) of the non-orbiting scroll 106 while maintaining a sealed engagement with the partition 32 to isolate discharge chamber 36 from the suction chamber 37. More specifically, in some configurations, pressure, and/or a biasing member 146, within the annular recess 138 may urge the seal assembly 20 into engagement with the partition 32, and the spiral wrap 120 of the non-orbiting scroll 106 into engagement with the endplate 108 of the orbiting scroll 104, during normal compressor operation.

The thermal protection system 27 may include a positioning body 150 and a displacement member 152. The positioning body 150 may include a hub 154 and a radially outwardly extending flange 156. The hub 154 may be disposed within the discharge passage 46 of the partition 32, and may be coupled to the non-orbiting scroll 106. For example, in some configurations, the hub 154 may be disposed within the recess 136 of the non-orbiting scroll 106, and may be coupled to the non-orbiting scroll 106 through a press-fit or threaded engagement within the recess 136. Accordingly, the positioning body 150 may be axially displaceable with the non-orbiting scroll 106 relative to the shell assembly 12, the seal assembly 20, and the partition 32.

The displacement member 152 may be disposed radially outwardly of the positioning body 150. In some configurations, the displacement member 152 may include a ring-shaped construct disposed annularly about the hub 154 of the positioning body 150. In an assembled configuration, the displacement member 152 may be disposed axially between the flange 156 and the partition 32, and the flange 156 is disposed axially between the partition 32 and the end cap 30. Accordingly, as will be explained in more detail below, the displacement member 152 can axially displace the positioning body 150 and the non-orbiting scroll 106 relative to the shell assembly 12 and the partition 32. In particular, the displacement member 152 may apply equal and opposite axially-extending forces on a lower surface 158 of the flange 156 and an upper surface 159 of the partition 32 in order to axially displace the positioning body 150 and the non-orbiting scroll 106 relative to the shell assembly 12 and the partition 32.

In some configurations, the displacement member 152 may include a material having shape-memory characteristics. In this regard, the displacement member 152 may be formed from a thermally-responsive shape memory material that changes shape, or otherwise activates, in response to a change in temperature. In particular, the displacement member 152 may be formed from a shape memory material that is thermally responsive at a predetermined threshold temperature. The predetermined threshold temperature may be between 30 degrees Celsius and 150 degrees Celsius. In some configurations, the displacement member 152 may be formed from a shape memory material that is thermally responsive at a predetermined threshold temperature of approximately 200 degrees Celsius. For example, in some configurations, the displacement member 152 may be formed from a bi- or tri-metal shape memory alloy such as a copper-zinc-aluminum alloy, a copper-aluminum-nickel alloy, an iron-manganese-silicon alloy, a nickel-aluminum alloy, or a nickel-titanium (nitinol).

Figure 2A:
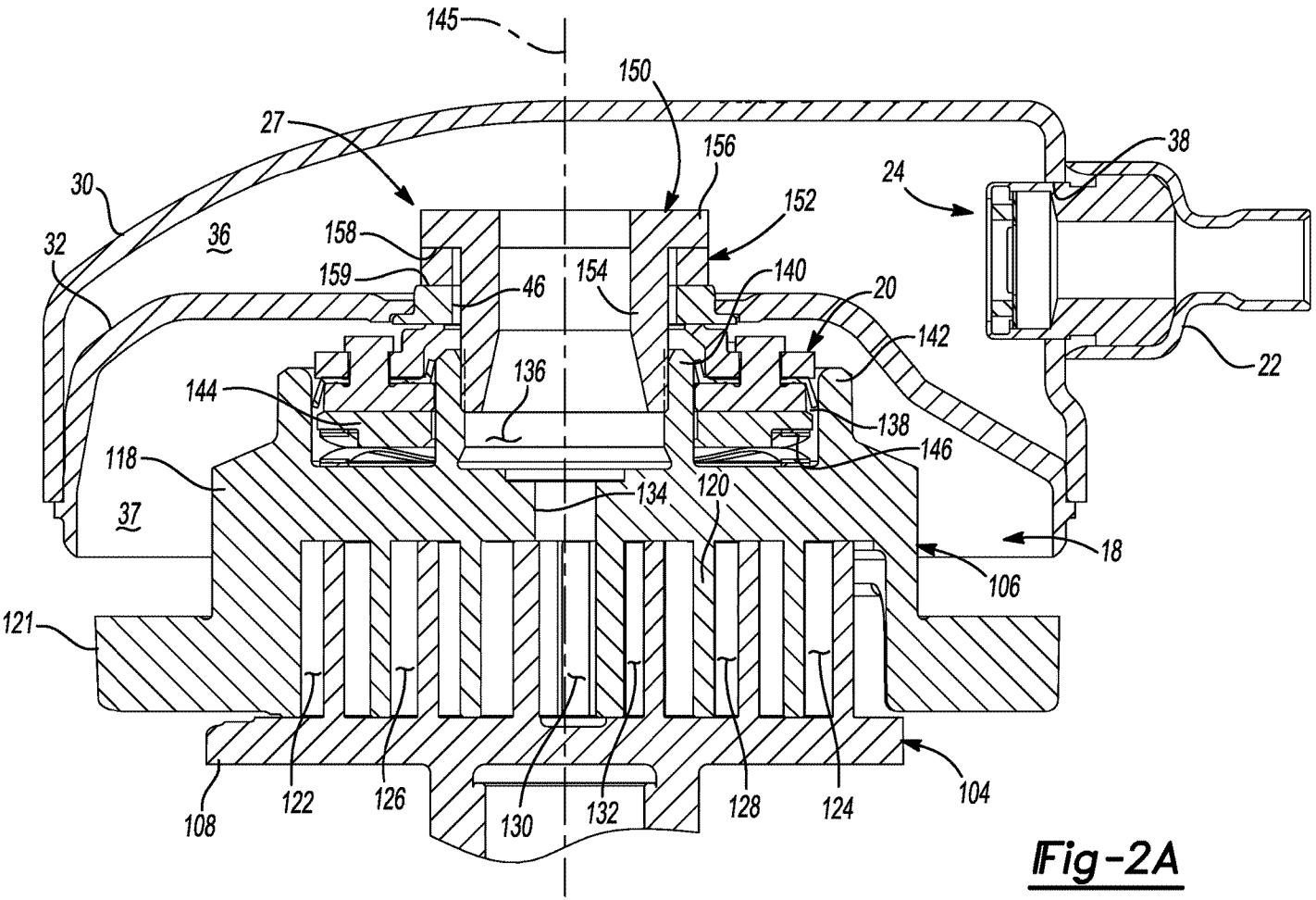
FIG. 2A is a partial cross-sectional view of a compressor incorporating the thermal protection system of FIG. 1, the thermal protection system shown in a deactivated position causing the compressor to operate in a full load operating condition.

Operation of the compressor 10 will now be described in more detail. When the displacement member 152 is deactivated (FIG. 2A), the compressor 10 may operate under full load conditions. In this regard, when the displacement member 152 is deactivated, the spiral wrap 120 of the non-orbiting scroll 106 may engage the endplate 108 of the orbiting scroll 104.

Figure 2B:
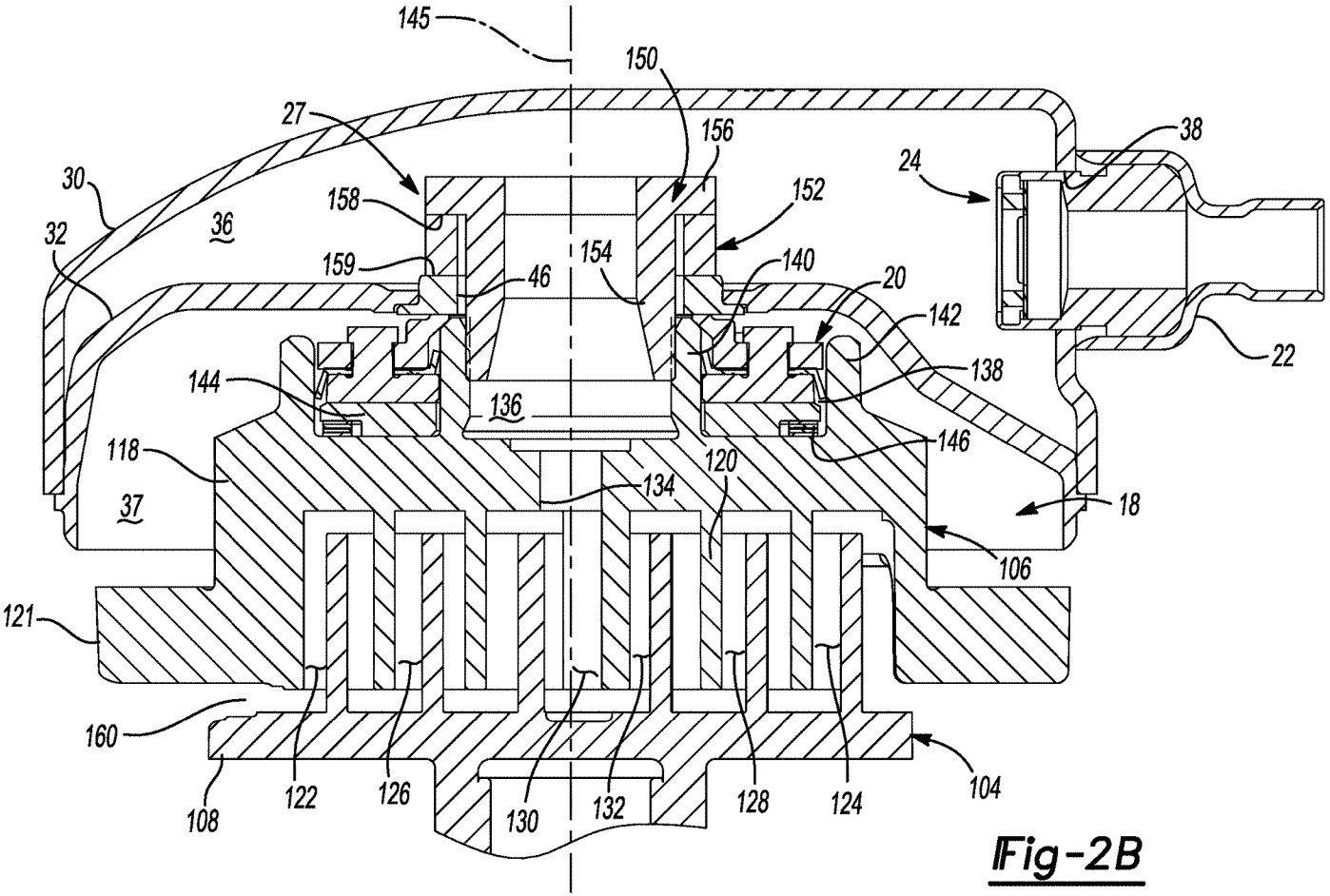
FIG. 2B is a partial cross-sectional view of a compressor incorporating the thermal protection system of FIG. 1, the thermal protection system shown in an activated position causing the compressor to operate in a no load operating condition.

As the compressor 10 operates under full-load conditions, a temperature of the displacement member 152 may increase. When the temperature of the displacement member 152 increases to a value that equals or exceeds the predetermined threshold temperature, the displacement member 152 may activate (FIG. 2B) and axially displace the positioning body 150 and the non-orbiting scroll 106 relative to the orbiting scroll 104. Accordingly, the spiral wrap 120 of the non-orbiting scroll 106 may define an axially-extending gap 160 with the endplate 108 of the orbiting scroll 104. The gap 160 allows the compressor 10 to operate under a no load condition in order to reduce the temperature of the displacement member 152. When the temperature of the displacement member 152 is reduced to a value that is below the predetermined threshold temperature, the displacement member 152 may deactivate such that the displacement member 152 returns to the configuration illustrated in FIG. 2A.

Figure 3:
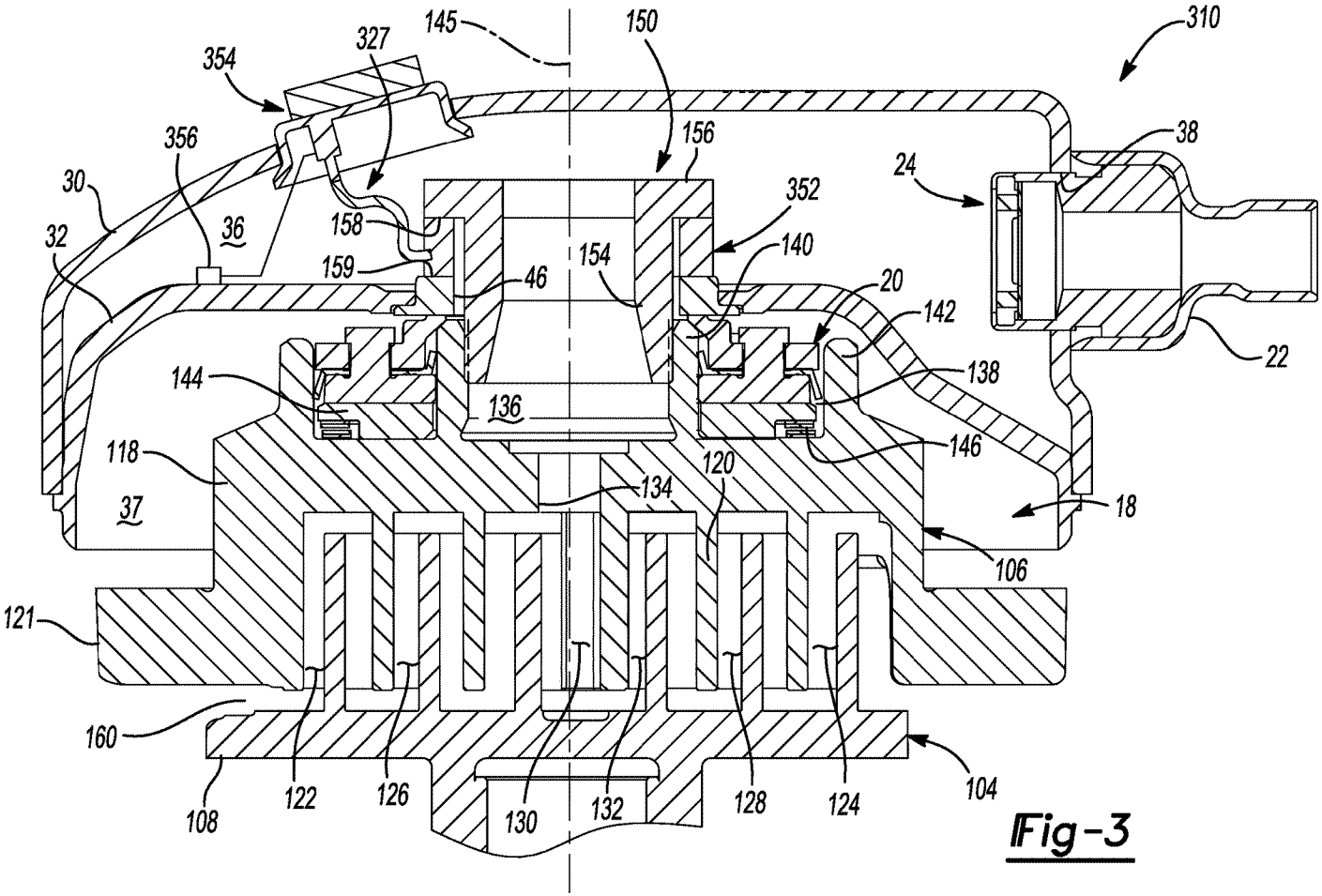
FIG. 3 is a partial cross-sectional view of a compressor incorporating another thermal protection system constructed in accordance with the principles of the present disclosure, the thermal protection system shown in an activated position causing the compressor to operate in a no load operating condition.

With reference to FIG. 3, a compressor 310 including another thermal protection system 327 is shown. The structure and function of the compressor 310 and the thermal protection system 327 may be substantially similar to that of the compressor 10 and the thermal protection system 27, respectively, illustrated in FIGS. 1-2B, apart from any exceptions described below and/or shown in the Figures.

The thermal protection system 327 may include a displacement member 352 and a control module 354. The control module 354 may control the displacement member 352 based on an operating temperature of the compressor 10. In this regard, the thermal protection system 327 may also include a temperature sensor 356 in communication with the control module 354. The temperature sensor 356 may sense an operating temperature of the compressor 310. When the operating temperature exceeds a threshold operating temperature, the control module 354 controls the displacement member 352, such that the displacement member 352 moves the non-orbiting scroll 106 from the deactivated configuration (FIG. 1) to the activated configuration (FIG. 3). Even though the control module 354 is shown external to the compressor, it should be understood that the control module could be located internal to the compressor along with temperature sensor 356. It should also be understood that the control module and sensor could be a single mechanism that can detect temperature and cause the compressor to run in a no load condition.

In some configurations, the control module 354 may activate the displacement member 352 in response to a signal received from the temperature sensor 356. In this regard, the control module 354 may provide an electrical current to the displacement member 352. The electrical current may activate the thermally-responsive or shape-memory characteristics of the displacement member 352. For example, the electrical current may increase the temperature of the displacement member 352. When the temperature of the displacement member 352 increases to a value that equals or exceeds the predetermined threshold temperature, the displacement member 352 may activate (FIG. 3), as described above with respect to FIGS. 1-2B. When the operating temperature is below the threshold operating temperature, the control module 354 removes the electrical current from the displacement member 352 in order to reduce the temperature of the displacement member 352, such that the displacement member 352 returns to the position illustrated in FIG. 1.

In another example, the displacement member 352 can be a piezoelectric material and the electric current may cause the displacement member 352 to activate its piezoelectric shape memory characteristics to axially displace the positioning body 150 and the non-orbiting scroll 106 relative to the orbiting scroll 104 as described above with respect to FIGS. 1-2B. When the operating temperature is below the threshold operating temperature, the control module 354 removes the electrical current from the displacement member 352 in order to return the displacement member 352 to the position illustrated in FIG. 1.

In yet another example, the displacement member 352 can be a magnetic shape memory material and the control module 354 can provide a magnetic field to the displacement member 352. The magnetic field may cause the displacement member 352 to activate its magnetic shape memory characteristics to axially displace the positioning body 150 and the non-orbiting scroll 106 relative to the orbiting scroll 104 as described above with respect to FIGS. 1-2B. When the operating temperature is below the threshold operating temperature, the control module 354 removes the magnetic field from the displacement member 352 in order to return the displacement member 352 to the position illustrated in FIG. 1.

Figure 4:
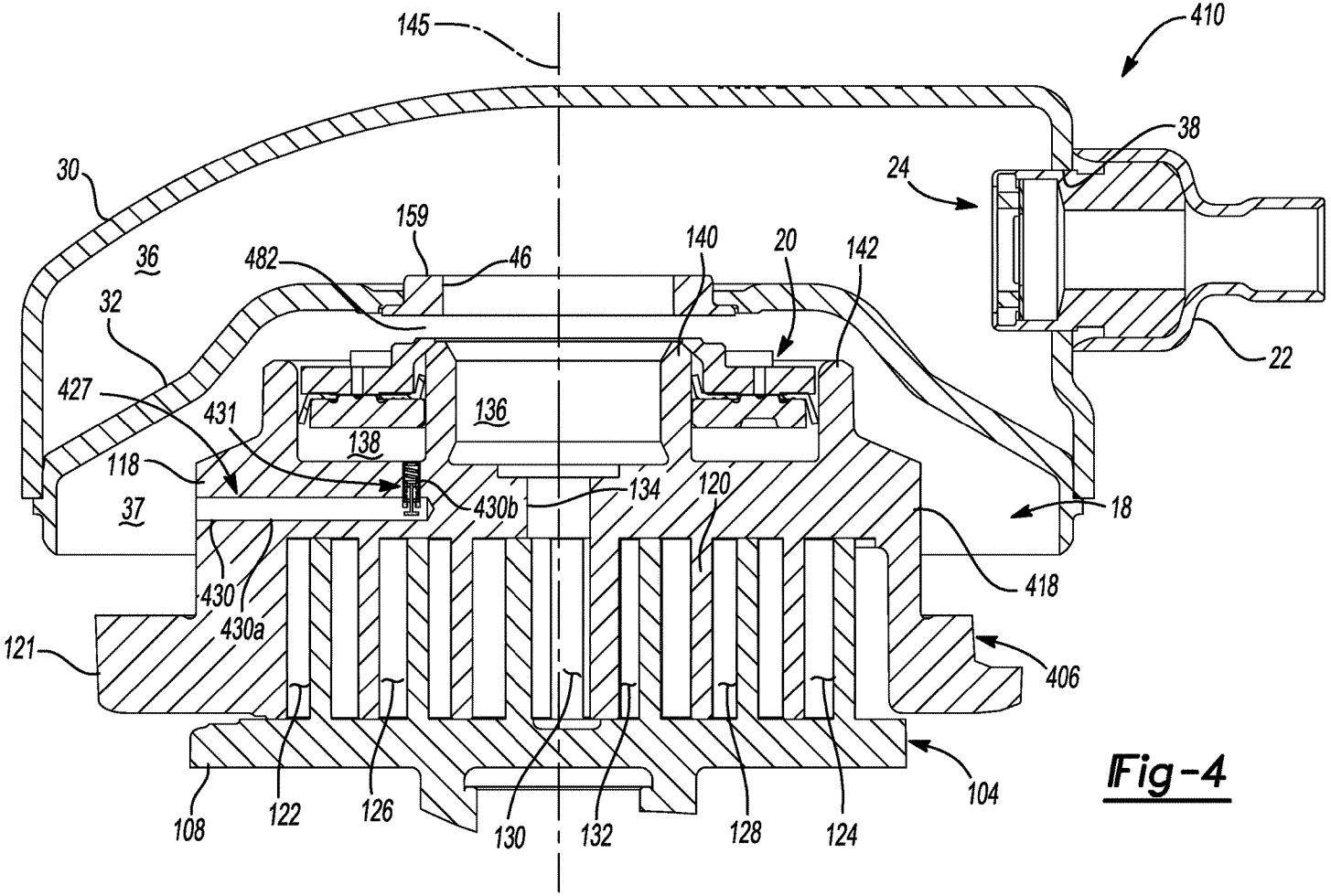
FIG. 4 is a partial cross-sectional view of a compressor incorporating another thermal protection system constructed in accordance with the principles of the present disclosure, the thermal protection system shown in an activated position causing the compressor to operate in a no load operating condition.

With reference to FIG. 4, a compressor 410 including another thermal protection system 427 is shown. The structure and function of the compressor 410 may be substantially similar to that of the compressor 10 illustrated in FIGS. 1-2B, apart from any exceptions described below and/or shown in the Figures.

The compressor 410 may include a non-orbiting scroll 406. The non-orbiting scroll 406 may include an endplate 418 having a passage 430. The passage 430 may be in fluid communication with the suction chamber 37 and with the annular recess 138 of the non-orbiting scroll 406. In this regard, the passage 430 may include a radially-extending portion 430*a* and an axially extending portion 430*b*.

The thermal protection system 427 may include a valve assembly 431 disposed within the passage 430. For example, in some configurations the valve assembly 431 may be at least partially disposed within the axially extending portion 430*b* of the passage 430.

Figure 5B:
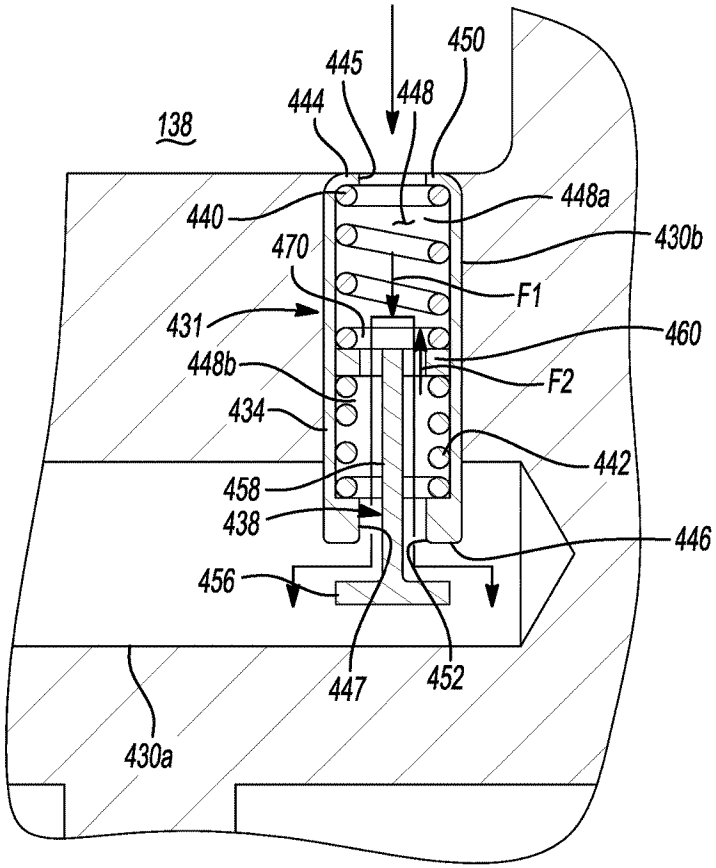
FIG. 5B is a cross-sectional view of the thermal protection system of FIG. 4 in an activated position causing the compressor to operate in a no load operating condition.
Figure 5A:
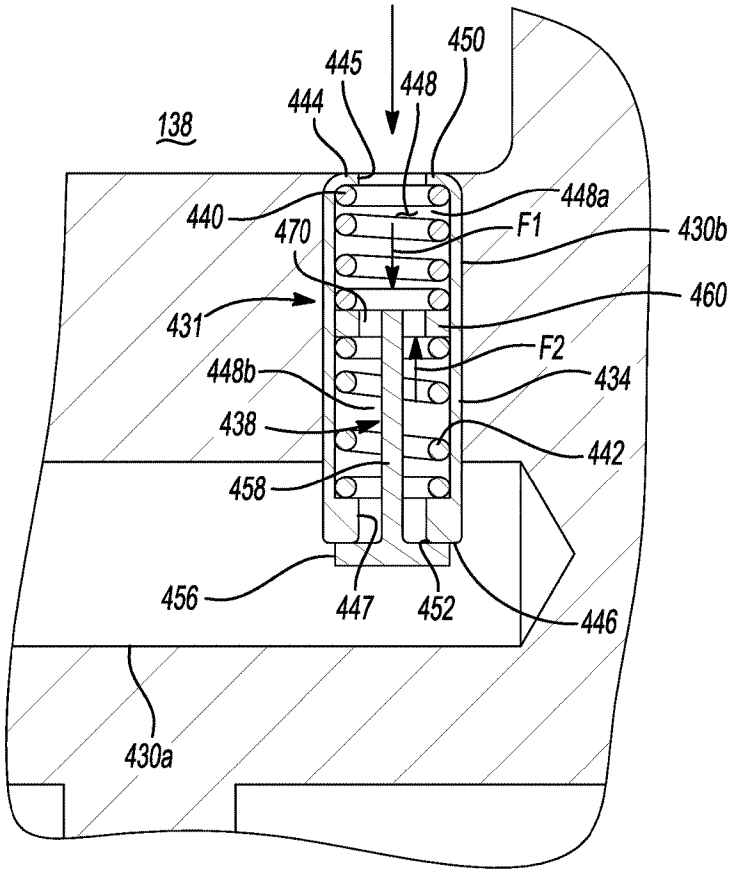
FIG. 5A is a cross-sectional view of the thermal protection system of FIG. 4 in the deactivated position causing the compressor to operate in the full load operating condition.

With reference to FIGS. 5A and 5B, the valve assembly 431 may include a housing 434, a valve body 438, a proximal biasing member 440, and a distal biasing member 442. The housing 434 may include a generally hollow construction extending from a proximal end 444 to a distal end 446. The proximal end 444 may define a fluid inlet 445 and the distal end 446 may define a fluid outlet 447 such that the generally hollow housing 434 defines a flow passage 448 extending from the proximal end 444 to the distal end 446. The proximal end 444 may include a first radially inwardly extending flange 450, and the distal end 446 may include a second radially inwardly extending flange 452. The first and second flanges 450, 452 may define the fluid inlet and outlet 445, 447, respectively.

The housing 434 may be disposed within the passage 430 such that the housing 434 is coupled to the non-orbiting scroll 406. In some configurations, the housing 434 may be secured to the non-orbiting scroll 406 through a press-fit configuration within the passage 430. As illustrated in FIGS. 5A and 5B, in the assembled configuration, the proximal end 444 of the housing 434 may be disposed adjacent to the annular recess 138, such that the inlet 445 is in fluid communication with the annular recess 138. The distal end 446 of the housing 434 may be disposed within the passage 430. For example, the distal end 446 of the housing 434 may be disposed within the radially extending portion 430*a* of the passage 430, such that the outlet 447 is configured to fluidly communicate with the passage 430 and the suction chamber 37.

The valve body 438 may include a head 456, a stem 458, and a guide 460. The stem 458 may extend between the head 456 and the guide 460, such that a cross section of the valve body 438 defines a generally I-shaped construct. The stem 458 and the guide 460 may be translatably disposed within the flow passage 448 of the housing 434. In this regard, the valve body 438 may be translatable between a closed position (FIG. 5A) and an open position (FIG. 5B) within the flow passage 448. As illustrated in FIG. 5A, in the closed position, the head 456 may sealingly engage the distal end 446 of the housing 434 to prevent fluid communication between the annular recess 138 and the suction chamber 37. As illustrated in FIG. 5B, in the open position, the head 456 may be spaced apart from the distal end 446 of the housing 434 to allow fluid communication between the annular recess 138 and the suction chamber 37 via the flow passage 448 and the passage 430.

The guide 460 may extend radially outwardly from the stem 458, such that, in the assembled configuration, the guide 460 engages the housing 434. Accordingly, the guide 460 may define a proximal portion 448*a* and a distal portion 448*b* of the flow passage 448. The guide 460 may further include one or more apertures 470 in fluid communication with the proximal and distal portions 448*a*, 448*b* of the flow passage 448.

The proximal biasing member 440 may include a helical construct disposed within the proximal portion 448*a* of the passage 448, such that the proximal biasing member 440 biasingly engages the housing 434 and the valve body 438. In particular, the proximal biasing member 440 may engage the first flange 450 and the guide 460, such that the proximal biasing member 440 biases the valve body 438 toward the open position (FIG. 5B).

The proximal biasing member 440 may include a material having shape-memory characteristics. In this regard, the proximal biasing member 440 may be formed from a thermally-responsive material that changes shape, or otherwise activates, in response to a change in temperature. In particular, the proximal biasing member 440 may be formed from a material that is thermally responsive at a predetermined threshold temperature. The predetermined threshold temperature may be between 30 degrees Celsius and 150 degrees Celsius. In some configurations, the proximal biasing member 440 may be formed from a material that is thermally responsive at a predetermined threshold temperature of approximately 200 degrees Celsius. For example, in some configurations, the proximal biasing member 440 may be formed from a bi- or tri-metal shape memory alloy such as a copper-zinc-aluminum alloy, a copper-aluminum-nickel alloy, an iron-manganese-silicon alloy, a nickel-aluminum alloy, or a nickel-titanium (nitinol).

The distal biasing member 442 may include a helical construct disposed within the distal portion 448*b* of the passage 448, such that the distal biasing member 442 biasingly engages the housing 434 and the valve body 438. In particular, the distal biasing member 442 may engage the second flange 452 and the guide 460, such that the distal biasing member 442 biases the valve body 438 toward the closed position (FIG. 5A).

Operation of the compressor 410 will now be described in more detail. The proximal biasing member 440 may apply a proximal force F1 on the guide 460, and the distal biasing member 442 may apply a distal force F2 (opposite the proximal force F1) on the guide 460. During normal operation of the compressor 410, the proximal force F1 may be less than the distal force F2 such that the valve body 438 is biased into the closed position (FIG. 5A). In this regard, the compressor 410 may operate under full load conditions when the valve body 438 is in the closed position.

As the compressor 410 operates under full-load conditions, a temperature of the proximal biasing member 440 may increase. When the temperature of the proximal biasing member 440 increases to a value that equals or exceeds the predetermined threshold temperature, the proximal biasing member 440 may activate such that the proximal force F1 exceeds the distal force F2, and the valve body 438 is biased into the open position (FIG. 5B). In the open position, the valve body 438 allows fluid within the annular recess 138 to flow into the suction chamber 37 in order to reduce the fluid pressure within the annular recess 138. As the fluid pressure within the annular recess 138 is reduced, the seal assembly 20 may translate axially downward (relative to the view in FIG. 4) within the annular recess 138, such that the seal assembly 20 and the partition 32 define a gap 482 therebetween. The gap 482 allows the discharge passage 134 and the recess 136 to fluidly communicate with the suction chamber 37, such that the compressor 410 operates under a no load condition when the valve body 438 is biased into the open position (FIG. 5B).

As the compressor 410 operates under a no load condition, the temperature of the proximal biasing member 440 is reduced. When the temperature of the proximal biasing member 440 is reduced to a value that is below the predetermined threshold temperature, the proximal biasing member 440 may deactivate such that proximal force F1 is less than the distal force F2. Accordingly, the proximal biasing member 440 may return to the configuration illustrated in FIG. 5A, such that the compressor 410 resumes operation under full-load conditions. In this regard, after the proximal biasing member 440 is deactivated, the seal assembly 20 may translate axially upward (relative to the view in FIG. 4) within the annular recess 138, such that the seal assembly 20 sealingly engages the partition 32.

Figure 6:
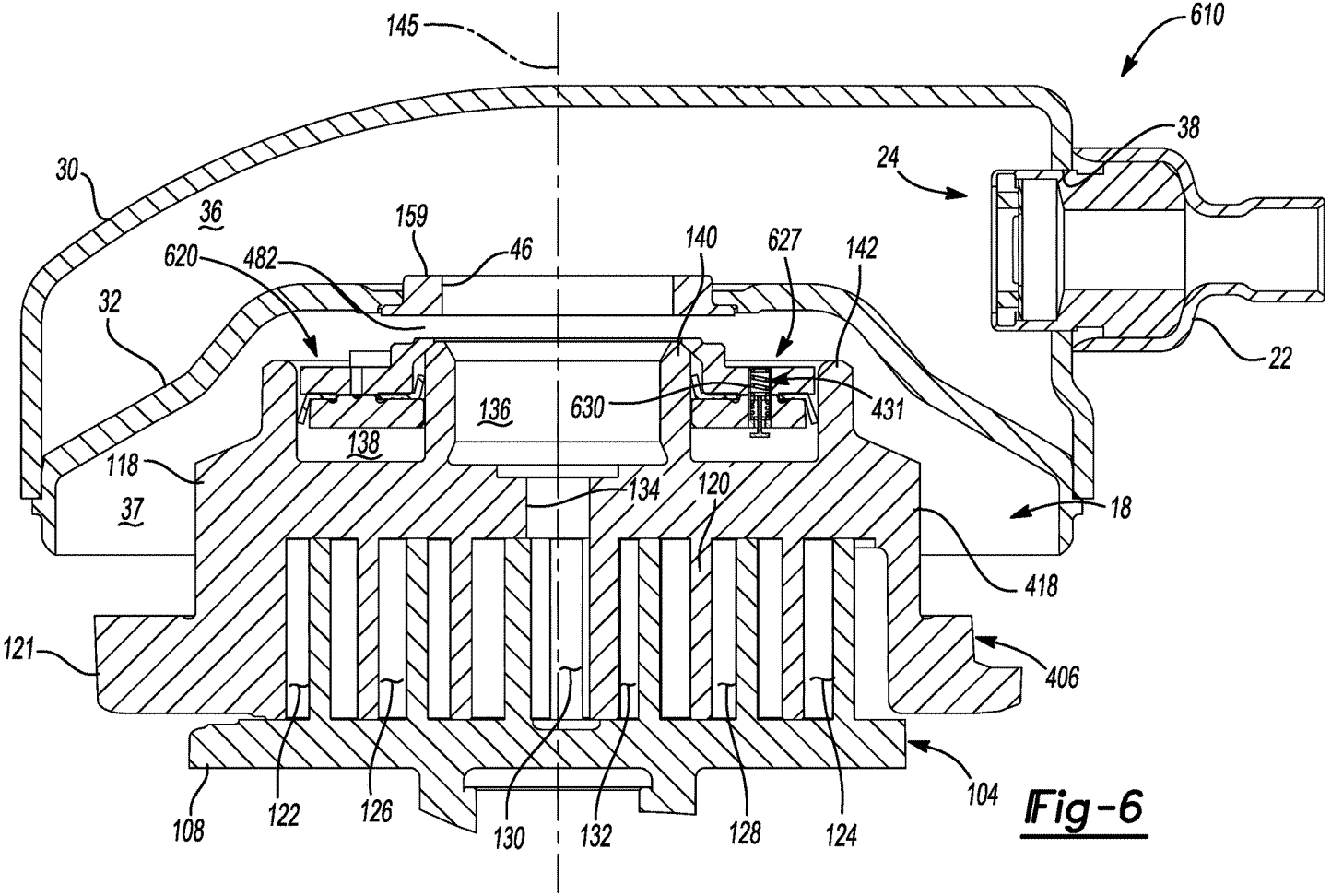
FIG. 6 is a partial cross-sectional view of a compressor incorporating another thermal protection system constructed in accordance with the principles of the present disclosure, the thermal protection system shown in an activated position causing the compressor to operate in a no load operating condition.

With reference to FIG. 6, a compressor 610 including another thermal protection system 627 is shown. The structure and function of the compressor 610 and the thermal protection system 627 may be substantially similar to that of the compressor 410 and the thermal protection system 427, respectively, apart from any exceptions described below and/or shown in the Figures. The compressor 610 may include a seal assembly 620 having a passage 630. The passage 630 may be in fluid communication with the suction chamber 37 and with the annular recess 138 of the non-orbiting scroll 406.

The thermal protection system 627 may include the valve assembly 431. The valve assembly 431 may be disposed within the passage 630. During normal operation of the compressor 610, the proximal force F1 may be less than the distal force F2 such that the valve body 438 is biased into the closed position illustrated in FIG. 5A. In this regard, the compressor 610 may operate under full load conditions when the valve body 438 is in the closed position.

When the temperature of the proximal biasing member 440 increases to a value that equals or exceeds the predetermined threshold temperature, the valve body 438 is biased into the open position (FIG. 5B). In the open position, the valve body 438 allows fluid within the annular recess 138 to flow into the suction chamber 37 in order to reduce the fluid pressure within the annular recess 138. As the fluid pressure within the annular recess 138 is reduced, the seal assembly 20 may translate axially downward (relative to the view in FIG. 6) within the annular recess 138, such that the gap 482 allows the recess 138 to fluidly communicate with the suction chamber 37. Accordingly, the compressor 610 operates under a no load condition when the valve body 438 is biased into the open position (FIG. 5B).

Figure 7:
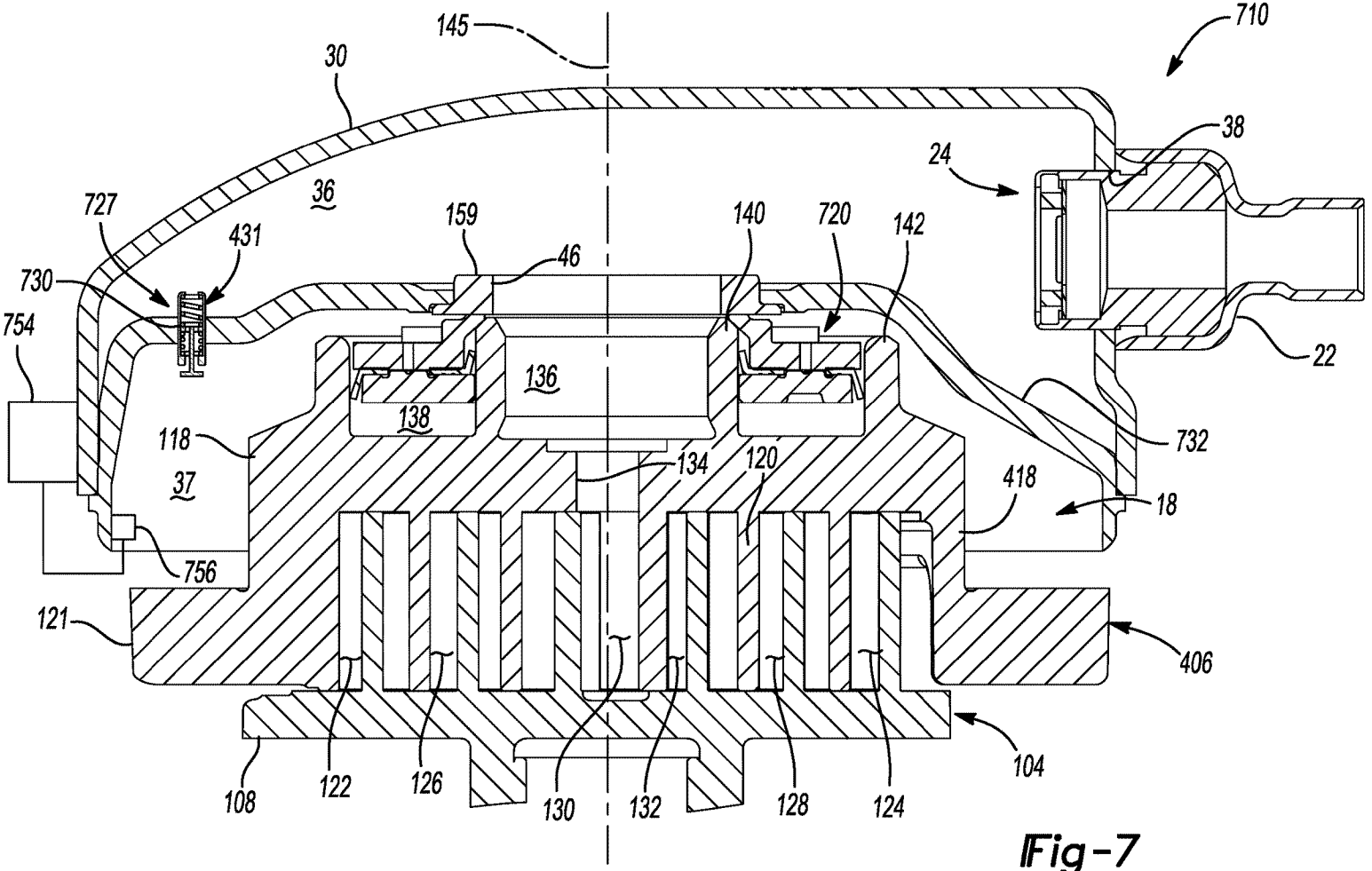
FIG. 7 is a partial cross-sectional view of a compressor incorporating another thermal protection system constructed in accordance with the principles of the present disclosure, the thermal protection system shown in an activated position causing the compressor to shut down.

With reference to FIG. 7, a compressor 710 including another thermal protection system 727 is shown. The structure and function of the compressor 710 and the thermal protection system 727 may be substantially similar to that of the compressor 410 and the thermal protection system 427, respectively, apart from any exceptions described below and/or shown in the Figures. The compressor 710 may include a partition 732 having a passage 730 in fluid communication with the suction chamber 37 and with the discharge chamber 36.

The thermal protection system 727 may include the valve assembly 431 and a motor control module 754. As will be explained in more detail below, the motor control module 754 may control the motor assembly 16 based on a temperature of the fluid in the discharge chamber 36. In this regard, the thermal protection system 727 may also include a temperature sensor 756 in communication with the motor control module 754.

The valve assembly 431 may be disposed within the passage 730. During normal operation of the compressor 710, the proximal force F1 may be less than the distal force F2 such that the valve body 438 is biased into the closed position (FIG. 5A). In this regard, the compressor 710 may operate under full load conditions when the valve body 438 is in the closed position.

When the temperature of the proximal biasing member 440 increases to a value that equals or exceeds the predetermined threshold temperature, the valve body 438 is biased into the open position (FIG. 5B). In the open position, the valve body 438 allows fluid to flow from the discharge chamber 36 to the suction chamber 37. The temperature sensor 756 may sense the temperature of the fluid flowing through the valve assembly 431 from the discharge chamber 36 to the suction chamber 37. When the temperature of the fluid flowing from the discharge chamber 36 to the suction chamber 37 exceeds a threshold operating temperature, the motor control module 754 may shut down the motor assembly 16, such that the compressor 710 ceases operation. Even though the control module 754 is shown external to the compressor, it should be understood that the control module could be located internal to the compressor along with temperature sensor 756. It should also be understood that the control module and sensor could be a single mechanism that can detect temperature and shutdown the motor assembly 16.

With reference to FIG. 8, a compressor 810 including another thermal protection system 827 is shown. The structure and function of the compressor 810 and the thermal protection system 827 may be substantially similar to that of the compressor 710 and the thermal protection system 727, respectively, apart from any exceptions described below and/or shown in the Figures.

The compressor 810 may include a non-orbiting scroll 806 having an endplate 818. The endplate 818 may include a passage 830 in fluid communication with the suction chamber 37 and with the discharge passage 134 or one of the pockets 124, 126, 128, 130, 132.

The thermal protection system 827 may include the valve assembly 431 and the motor control module 754. The valve assembly 431 may be disposed within the passage 830. During normal operation of the compressor 810, the proximal force F1 may be less than the distal force F2 such that the valve body 438 is biased into the closed position illustrated in FIG. 5A. In this regard, the compressor 810 may operate under full load conditions when the valve body 438 is in the closed position.

When the temperature of the proximal biasing member 440 increases to a value that equals or exceeds the predetermined threshold temperature, the valve body 438 may be biased into the open position (FIG. 5B). In the open position, the valve body 438 allows fluid within the discharge passage 134 to flow into the suction chamber 37. The temperature sensor 756 may sense the temperature of the fluid flowing through the valve assembly 431 from the discharge passage 134 to the suction chamber 37. When the temperature of the fluid flowing from the discharge passage 134 to the suction chamber 37 exceeds the threshold operating temperature, the motor control module 754 may shut down the motor assembly 16, such that the compressor 810 ceases operation. Even though the control module 754 is shown external to the compressor, it should be understood that the control module could be located internal to the compressor along with temperature sensor 756. It should also be understood that the control module and sensor could be a single mechanism that can detect temperature and shutdown the motor assembly 16.

With reference to FIG. 9, a compressor 910 including another thermal protection system 927 is shown. The structure and function of the compressor 910 and the thermal protection system 927 may be substantially similar to that of the compressor 810 and the thermal protection system 827, respectively, apart from any exceptions described below and/or shown in the Figures.

The compressor 910 may include an orbiting scroll 904 having an endplate 908. The endplate 908 may include a passage 930 in fluid communication with the suction chamber 37 and with one of the pockets 124, 126, 128, 130, 132. In some configurations, the passage 930 is in fluid communication with the outlet pocket 132. The passage 930 may include a radially-extending portion 930*a* and an axially extending portion 930*b*.

The thermal protection system 927 may include the valve assembly 431 and the motor control module 754. The valve assembly 431 may be disposed within the passage 930. For example, in some configurations the valve assembly 431 may be at least partially disposed within the radially extending portion 930*a* of the passage 930. During normal operation of the compressor 910, the proximal force F1 may be less than the distal force F2 such that the valve body 438 is biased into the closed position illustrated in FIG. 5A. In this regard, the compressor 910 may operate under full load conditions when the valve body 438 is in the closed position.

When the temperature of the proximal biasing member 440 increases to a value that equals or exceeds the predetermined threshold temperature, the valve body 438 may be biased into the open position (FIG. 5B). In the open position, the valve body 438 allows fluid within one or more of the pockets 124, 126, 128, 130, 132 to flow into the suction chamber 37. The temperature sensor 756 may sense the temperature of the fluid flowing through the valve assembly 431 from the pocket(s) 124, 126, 128, 130, 132 to the suction chamber 37. When the temperature of the fluid flowing from the pocket(s) 124, 126, 128, 130, 132 to the suction chamber 37 exceeds the threshold operating temperature, the motor control module 754 may shut down the motor assembly 16, such that the compressor 910 ceases operation. Even though the control module 754 is shown external to the compressor, it should be understood that the control module could be located internal to the compressor along with temperature sensor 756. It should also be understood that the control module and sensor could be a single mechanism that can detect temperature and shutdown the motor assembly 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:

a housing;

a partition disposed within the housing, the partition defining a suction chamber and a discharge chamber, and including a discharge passage in fluid communication with the discharge chamber;

a first scroll supported within said housing and including a first endplate having a first spiral wrap extending therefrom;

a second scroll supported within said housing and including a second endplate having a first side and a second side opposite the first side, the first side having a second spiral wrap extending therefrom and meshingly engaged with said first spiral wrap to form a series of compression pockets; and a thermal protection system including a positioning body and a displacement member, the positioning body coupled to the second scroll and translatable relative to the discharge passage, the displacement member disposed between the positioning body and the partition and configured to translate the second scroll relative to the first scroll between first and second positions in response to a change in an operating temperature of the compressor.

2. The compressor of claim 1, wherein the displacement member comprises a shape memory material.

3. The compressor of claim 2, wherein the shape memory material includes at least one of a bi-metal and tri-metal shape memory alloy configured to translate the second scroll in response to a change in temperature of the displacement member.

4. The compressor of claim 1, wherein the second side of the second scroll includes a first recess in fluid communication with at least one of the series of compression pockets, and a second recess surrounding the first recess, the compressor further comprising a seal assembly translatably disposed within the second recess and sealingly engaged with the partition, wherein the seal assembly is displaceable between first and second positions within the second recess.

5. The compressor of claim 1, wherein the positioning body includes a hub and a radially extending flange, and wherein the displacement member engages the flange and the partition.

6. The compressor of claim 5, wherein the displacement member surrounds the hub.

7. The compressor of claim 1, wherein the thermal protection system further includes a control module operable to change a state of the displacement member in response to the operating temperature of the compressor.

8. The compressor of claim 7, further comprising a temperature sensor that senses the operating temperature of the compressor.

9. The compressor of claim 8, wherein the temperature sensor is disposed within at least one of the discharge chamber and the suction chamber.

10. The compressor of claim 7, wherein the control module is configured to selectively provide one of an electric current and a magnetic field to the displacement member to change the state of the displacement member.

* * * * *